United States Patent [19]

Brock et al.

[11] 3,948,204

[45] Apr. 6, 1976

[54] APPARATUS FOR PIVOTALLY MOUNTING AN OUTBOARD MOTOR ON A FISHING BOAT

[75] Inventors: John O. Brock; Marmion Dean Davis; James Robert Wray, all of Shelby, N.C.

[73] Assignee: Interstate Industries, Inc., Shelby, N.C.

[22] Filed: Mar. 27, 1975

[21] Appl. No.: 562,597

[52] U.S. Cl. ..... 115/18 E; 248/4

[51] Int. Cl.[2] ..... B63H 21/26

[58] Field of Search ..... 115/41 R, 17, 18 R, 18 E, 115/18 A; 248/4

[56] References Cited

UNITED STATES PATENTS

| | | | |
|---|---|---|---|
| 3,724,790 | 4/1973 | Harris et al. | 115/17 |
| 3,870,258 | 3/1975 | Shimanckas et al. | 115/17 |
| 3,881,443 | 5/1975 | Hamp | 115/41 R |

*Primary Examiner*—Trygve M. Blix
*Assistant Examiner*—Gregory W. O'Connor
*Attorney, Agent, or Firm*—Parrott, Bell, Seltzer, Park & Gibson

[57] ABSTRACT

An apparatus for pivotally mounting an outboard fishing motor, such as a shaft-mounted submersible electric motor, on the bow of a fishing boat or the like for pivotal movement between an operative position wherein the motor is held in the water and a non-operative raised position. The apparatus comprises an elongated mounting frame, a slide block carried by the mounting frame, and a bracket pivotally carried by the slide block for supporting the shaft of the motor. A power control system is provided which includes a reversible electric motor and cable arrangement for selectively translating the slide block in either direction, and a pivoting and lifting arrangement is included which serves to lift the outboard motor into its raised position overlying the mounting frame.

12 Claims, 7 Drawing Figures

APPARATUS FOR PIVOTALLY MOUNTING AN OUTBOARD MOTOR ON A FISHING BOAT

The present invention relates to a powdered apparatus for automatically pivoting an outboard fishing motor between a lowered operative position wherein the motor is held in the water, and a raised non-operative position wherein the motor is removed from the water.

It is known to mount a small auxiliary motor on the bow of a fishing boat for use while trolling. Typically, the motor is a shaft-mounted electric motor, and comprises an elongated shaft having a submersible electric motor and propeller mounted at the lower end thereof, and a steering handle or the like mounted at the upper end of the shaft. The motor is powered by a suitable battery carried in the boat, and a speed control rheostat may also be provided for controlling the speed of the motor and thus the speed of the boat through the water.

It has also been proposed to pivotally mount a motor of the described type on the bow to permit the motor to be retracted from the water in the event the fishing lines become snagged, or if it is desired to move the boat under full power from the main motor. In this regard, various pivotal mounting brackets have been developed and marketed, and wherein the boat operator manually raises and lowers the motor between its operative and non-operative positions, note for example the U.S. Pat. to Ibbs, No. 3,245,640.

The above manual raising and lowering operations can easily become tiring and aggravating, particularly when it is realized that the boat operator normally is positioned in the middle or at the stern of the boat while fishing, and he must therefore move to the front of the boat each time the motor is to be raised or lowered. In this regard, various rope arrangements have been proposed for permitting the operator to raise or lower the motor while he is located at the middle or stern of the boat, but such ropes tend to become snagged in the fishing lines and other boat equipment, and thus they have not been entirely satisfactory. Further, the electric outboard motor is often of considerable size and weight, making the lifting and lowering operations physically difficult.

It is accordingly an object of the present invention to provide an apparatus for pivoting a relatively large and heavy outboard fishing motor between its operative and non-operative positions and which avoids the above noted problems associated with the presently known devices.

It is another object of the present invention to provide a powered apparatus for selectively pivoting an outboard fishing motor, such as a shaft-mounted submersible electric motor, between a lowered position wherein the motor is operatively held in the water and a raised position wherein the motor is removed from the water.

It is a further object of the present invention to provide an apparatus of the described type which may be remotely controlled by the boat operator, and which automatically terminates its operation upon the motor reaching either the operative or the non-operative position.

It is still another object of the present invention to provide an apparatus of the described type which pivots the motor under controlled conditions in both directions, and which is essentially locked on its operative position to thereby preclude the motor from lifting from the water during operation.

These and other objects and advantages of the present invention are achieved in the embodiment illustrated herein by the provision of an apparatus which comprises an elongated mounting frame adapted to be fixedly attached to the bow of the boat, a slide block mounted for slideable movement along the mounting frame, and a bracket pivotally carried by the slide block and being pivotable between a horizontal position overlying the slide block and an upright vertical position. The bracket carries means for attaching the shaft of the outboard motor thereto, and power means is provided for selectively translating the slide block in either direction between a forward and a withdrawn position. A guide roller is positioned adjacent the outer end of the mounting frame for engaging and pivoting the shaft of the outboard motor during rearward translation of the slide block, and a linkage is pivotally carried by the mounting frame adjacent its outer end for engaging the shaft of the outboard motor and lifting the same to its raised position above the mounting frame during rearward translation of the slide block.

Some of the objects and advantages of the invention having been stated, others will appear as the description proceeds when taken in connection with the accompanying drawings, in which FIG. 1 is a perspective view illustrating an apparatus embodying the features of the present invention and the manner in which the apparatus may be mounted on a conventional fishing boat;

Referring more particularly to the drawings, an apparatus embodying the features of the present invention is indicated generally at 10, and is shown as being attached to the bow of a conventional fishing boat 12. The boat 12 typically includes a conventional internal combustion outboard motor (not shown) mounted at the stern for powering the boat at relatively high speeds in the normal manner.

Figure 1:
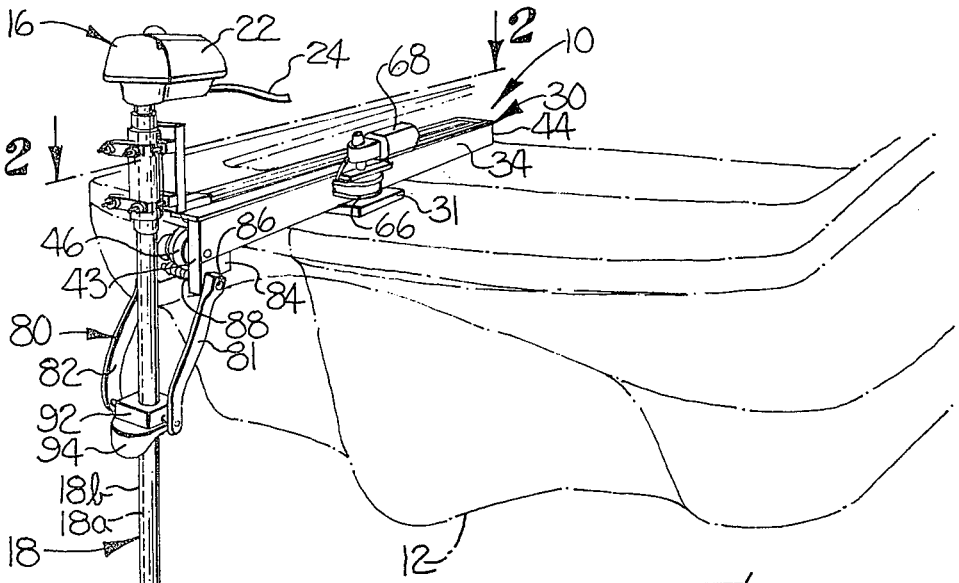
Figures 5, 6, 7:
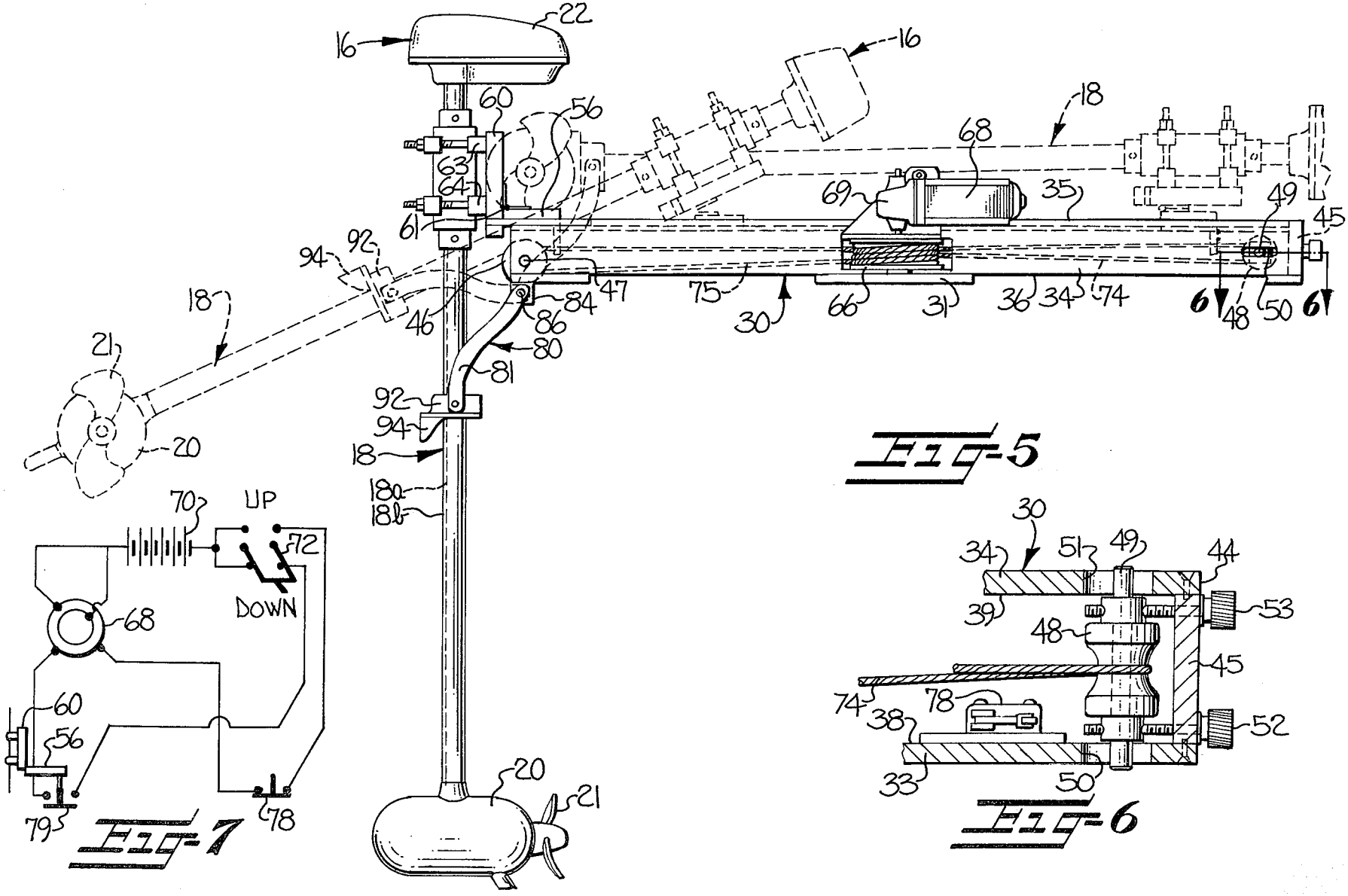
FIG. 5 is a side elevation view of the apparatus and supported motor in the operative position, and further showing in dashed lines the apparatus and motor in an intermediate position and the raised or withdrawn position.
FIG. 6 is a fragmentary plan view taken substantially along the line 6—6 of FIG. 5.
FIG. 7 is a schematic wiring diagram of the power control system for the apparatus of the present invention.

In accordance with the present invention, the apparatus 10 is adapted to pivotally mount an auxiliary outboard motor 16 for movement between a vertically disposed operative position shown in FIG. 1 and in solid lines in FIG. 5, and the horizontally disposed non-operative position shown in dashed lines in FIG. 5. The illustrated motor 16 is conventional and will therefore only be generally described herein. As illustrated, the motor 16 comprises an elongated shaft 18 having a submersible electric motor 20 and propeller 21 carried at the lower end thereof. An automatic steering control system is also provided which comprises a housing 22 carried at the upper end of the shaft 18, and a foot pedal (not shown) positioned within the boat and adjacent the operator. The housing 22 and foot pedal are interconnected by a suitable cable 24, such that movement of the pedal is adapted to pivot the motor in either direction about the axis of the shaft 18 to effect steering thereof.

The shaft 18 comprises an inner tubular member 18*a* and a coaxial outer sleeve 18*b* which are relatively rotatable about their common axis. The inner tubular member 18*a* is directly connected between the steering control system within the housing 22 and the motor 20 to permit steering of the motor in the manner described above, and with the sleeve 18*b* and housing itself being held stationary. An electric cord (not shown) extends upwardly through the shaft 18 and along the cable 24, and is operatively connected to a suitable battery (not shown), such as 12 volt automotive battery, for powering the motor 20. Also, a suitable switch and rheostat (not shown) may be positioned adjacent the foot pedal for selectively controlling the operation and speed of the motor 20.

Figure 3:
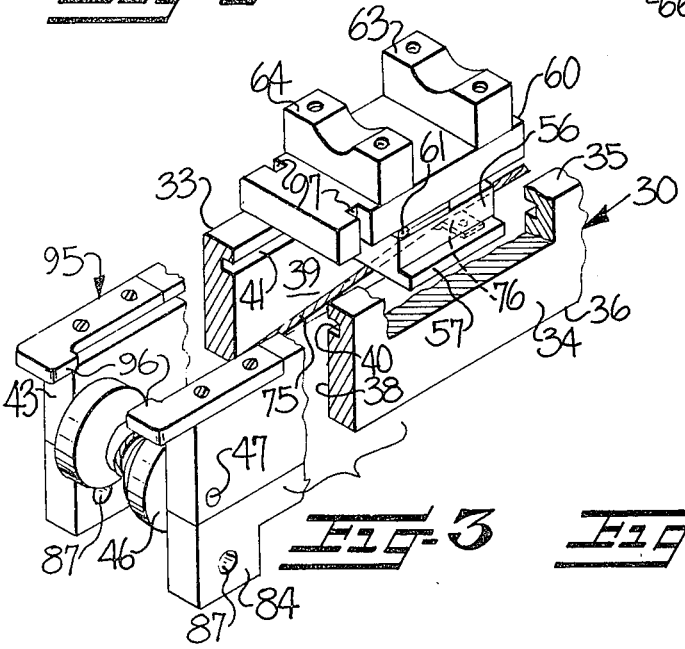
FIG. 3 is a fragmentary perspective view illustrating the outer end portion of the mounting frame, together with the slide block and bracket.

The apparatus 10 of the present invention comprises a mounting frame 30 which includes a generally flat plate 31 which is adapted to be secured to the bow of the boat, by bolts or the like, and so as to assume a generally horizontal orientation. A pair of elongated rails 33, 34 are fixedly attached to the plate 31, as by welding, the rails being of generally rectangular cross sectional configuration to define upper and lower edges 35, 36 respectively. Also, the rails are disposed in a spaced apart, parallel arrangement to define inwardly facing, opposing surfaces 38 and 39. Each of the opposing surfaces includes a longitudinal slot 40, 41, respectively, extending along the length thereof as best seen in FIG. 3, the slots 40, 41 being horizontally aligned with each other for the purposes set forth below.

When positioned upon the bow of the boat 12 as illustrated in FIG. 1, the mounting frame 30 extends in a generally horizontal direction and defines an outer end 43 positioned beyond the bow, and an opposite inner end 44. A guide roller 46 is mounted between the rails for rotation about a transversely directed pin 47 which is fixedly positioned between the rails adjacent the outer end 43 of the frame. A pulley 48 is similarly mounted between the rails adjacent the inner end 44 of the frame, and an end wall 45 extends transversely between the rails of the inner end thereof. The pulley 48 is mounted for rotation about the transversely directed pin 49, and the pin 49 is received within the longitudinal slots 50, 51 in the rails as best seen in FIG. 6. A pair of adjustment screws 52, 53 are rotatably carried by the end wall 45 of the frame, and are operatively connected to the pin 49 to permit adjustment of the positioning of the pulley 48 in the longitudinal direction.

The apparatus 10 of the present invention further comprises a slide block 56 mounted for linear movement along substantially the full length of the mounting frame, and between a forward position adjacent the outer end 43 of the frame and a withdrawn position adjacent the inner end 44 of the frame. The slide block 56 is generally rectangular in configuration, and includes a transversely projecting, thin follower 57 extending from each side of the block. The followers 57 are configured to be received within the slots 40, 41 of the rails, such that the followers and slots serve to mount the slide block 56 on the frame 30 while permitting the desired slideable linear movement.

Figure 4:
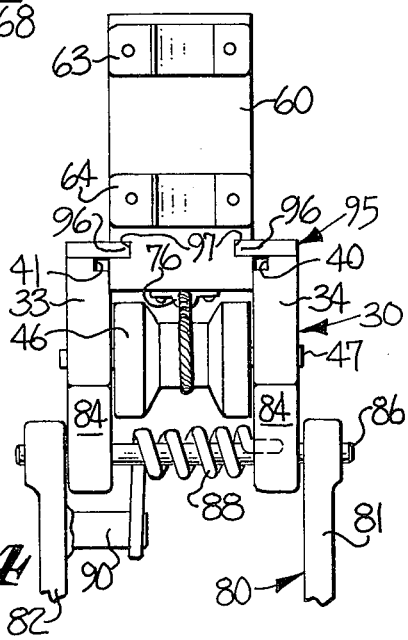
FIG. 4 is a front elevation view of the apparatus.

A bracket 60 is pivotally secured to the slide block 56 by means of the hinge 61, such that the bracket 60 is pivotable about an axis extending transverse to the direction of sliding movement of the slide block. In addition, the bracket is pivotable between a horizontal position overlying the slide block (FIG. 3) and an upright vertical position (FIGS. 1 and 4). The bracket 60 in turn carries a pair of spaced mounting clamps 63, 64 for attaching the shaft of the outboard motor 16 thereof, and such that the motor 16 is substantially horizontally disposed when the bracket is in its horizontal position, and is substantially vertically disposed when the bracket is in its vertical position. The clamps 63, 64 extend forwardly from the bracket such that the motor 16 is held forwardly of the mounting frame 30 when the slide block 56 is in its forward position and the bracket is in its upright position (note FIG. 1).

As will be understood, the depth to which the motor 20 is disposed in the water may be controlled by releasing the clamps 63, 64, and then sliding the shaft 18 axially to its desired relative position. Upon tightening of the clamps, the outer sleeve 18*b* and the housing 22 are fixedly secured thereto, but steering is permitted in view of the relative rotation between the outer sleeve 18*b* and inner tubular member 18*a* of the shaft as described above.

A power system is provided for selectively and remotely translating the slide block 56 between its forward and withdrawn positions, to thereby pivot the bracket 60 and outboard motor 16 between their vertical and horizontal positions in a manner hereinafter further described. The power system comprises a drive wheel 66 carried at a medial location along the length of the frame 30 and mounted for rotation about a fixed vertical axis. A reversible electric motor 68 acts through a gear reduction box 69 to rotate the drive wheel 66 in either direction. The motor 68 is operatively connected to and powered by a battery 70 which is manually controlled by the switch 72 as seen in FIG. 7. The battery 70 may also be employed for powering the motor 20 as described above.

Figure 2:
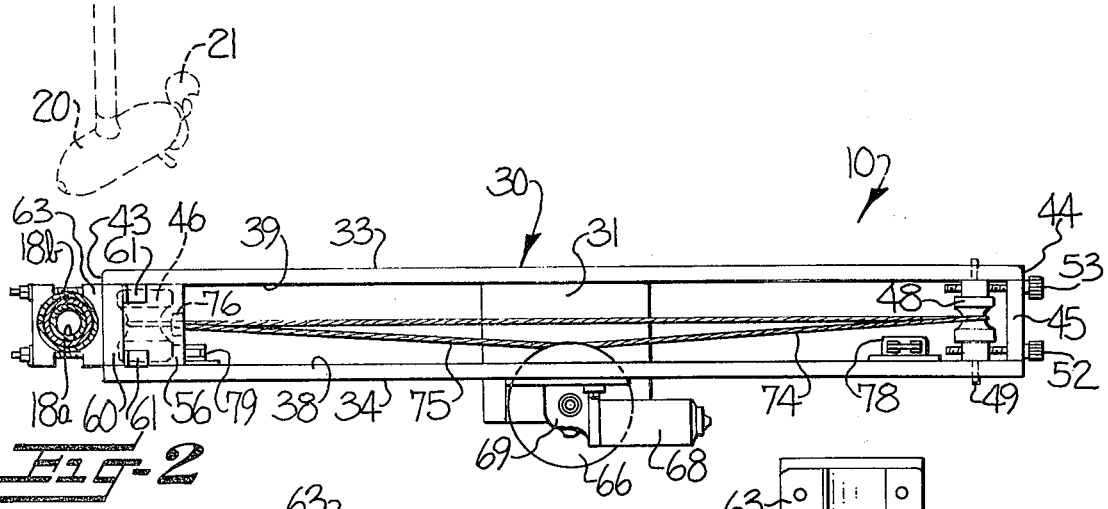
FIG. 2 is a top plan view of the apparatus taken substantially along the line 2—2 of FIG. 1.

In accordance with the illustrated embodiment of the present invention, a pair of cable segments 74, 75 operatively interconnect the drive wheel 66 and the slide block 56, whereby the slide block 56 may be translated from its forward position to its withdrawn position upon rotation of the drive wheel in a first direction, and the slide block 56 may be reversely translated upon rotation of the drive wheel in the opposite direction. More particularly, a first cable segment 74 has one end thereof fixed to the drive wheel and wound thereabout in a clockwise direction as seen in FIG. 2. The other end of the segment 74 is entrained about the pulley 48, and extends along and between the rails 33, 34 of the mounting frame and is attached to the slide block at 76.

The second cable segment 75 has one end fixed to the drive wheel and is wound thereabout in a counterclockwise direction as seen in FIG. 2. The other end of the segment 75 is entrained about the guide roller 46 and is attached to the slide block at 76 from the opposite direction. Thus rotation of the drive wheel 66 in a counterclockwise direction acts to translate the slide block rearwardly along the length of the mounting frame, while clockwise rotation acts to translate the slide block forwardly along the mounting frame. In this regard, it will be noted that the adjusting screws 52, 53 may be employed to maintain a desired degree of tension in the two cable segments 74, 75.

A pair of limit switches 78, 79 are carried on the inner surface 38 of the rail 34, with the switch 78 being positioned adjacent the inner end 44, and the switch 79 being positioned adjacent the outer end 43. The switch 78 is engaged by the slide block 56 upon reaching its withdrawn position, and the switch 79 is engaged by the slide block upon reaching its forward position, to terminate operation of the motor 68 (note FIG. 7). If desired, the limit switches 78, 79 may be mounted in a manner which permits ready adjustment in the longitudinal direction along the rail to thereby facilitate control of the point at which the operation of the motor terminates. Also, the manually operable control switch 72 is provided for selectively operating the motor 68 in either direction, the switch 72 typically being positioned adjacent the operator so as to be conveniently controlled without requiring his movement to the bow of the boat.

The apparatus 10 further comprises means for pivoting and lifting the outboard motor 16 from its vertically disposed operative position forwardly of the mounting frame (FIG. 1) to a horizontally disposed raised position overlying the mounting frame during translation of the slide block 56 from its forward position to its withdrawn position, and for pivoting and lowering the motor 16 from its raised position to its vertically disposed position during translation of the slide block from its withdrawn position to its forward position. This pivoting means includes the guide roller 46 as described above, and further comprises a linkage 80 in the form of a pair of interconnected arms 81, 82, the inner end of each arm being pivotally attached to the mounting frame 30 at the outer end 43 thereof. More particularly, a mounting block 84 is fixedly carried along the lower edge 36 of each rail adjacent the outer end 43, and a pin 86 extending transversely between the blocks 84, and is rotatably disposed within the apertures 87, note FIG. 3. Each arm of the linkage 80 is fixedly attached to the pin 86 for concurrent pivotal movement. Also, a helical spring 88 is disposed about the pin 86 between the rails, one end of the spring being secured to one of the blocks 84 and thus the frame 30, and the other end of the spring engaging a transverse projection 90 on the arm, note FIG. 4.

A guide sleeve 92 is pivotally carried between the arms 81, 82 at the free end of the linkage 80, and is adapted to slideably receive the shaft 18 of the outboard motor 16 therewithin. The sleeve is desirably fabricated from split sections to facilitate the attachment of the motor 16 to the apparatus 10 as further described below. Also, an arcuately shaped guide flange 94 is carried between the arms 81, 82 of the linkage and below the sleeve 92. The flange 94 is designed to rotate the motor 20 into a predetermined orientation with respect to the frame 30 during translation of the motor 16 to its raised position as more fully described below.

As will be apparent from FIG. 5, the linkage 80 has a length such that the guide sleeve 92 may be freely pivoted about the outer end 43 of the mounting frame and the sleeve is positioned in spaced relation above the mounting frame when the linkage is pivoted to a vertically upright position. In addition, the helical spring 88 serves to bias the linkage 80 in a downward rotational direction about the outer end of the mounting frame (counterclockwise as seen in FIG. 5) for the purposes hereinafter set forth.

The apparatus 10 of the present invention further comprises means for automatically and positively locking the bracket 60 in its vertical position upon the slide block 56 being translated into its forward position to thereby maintain the motor 16 in its operative position and preclude its lifting from the water during operation. As illustrated, the locking means comprises a generally flat key 95 attached to the upper edge 35 of each rail adjacent the outer end thereof. Each key 95 includes an inwardly directed tab 96 such that the two tabs are in opposed relationship. The bracket 60 includes a cooperating channel 97 in each side edge thereof, the channels 97 being configured to receive the tab 96 of the associated key when the bracket is in its vertical position and the slide block is in its forward position. By this arrangement, pivotal movement of the bracket about the axis of the hinge 61 is effectively precluded. In this regard, it will be noted that the biasing force of the helical spring 88 also serves to maintain the motor in its operative position. Further, the reduction gear box 69 serves to resist inadvertent rotation of the drive wheel 66 caused by tension in the cable segments 74, 75, and it thus resists inadvertent translation of the slide block 56 to further assist in retaining the bracket 60 and motor 16 in the desired operative position.

While the means for interconnecting the drive wheel 66 and slide block 56 has been described above as comprising two cable segments, each having an end secured to the circumference of the drive wheel, it will be understood that the cable segments could comprise a unitary cable which is wound about the drive wheel a number of times without being fixedly connected thereto. This latter arrangement has the advantage of serving as a slip-clutch between the drive wheel and slide block in the event an obstruction is encountered in the pivotal movement of the bracket and motor. It will also be understood that other drive arrangements, such as a worm screw drive, could be employed for translating the slide block 56 along its path of travel.

In use, the operator initially mounts the motor 16 on the apparatus 10 by locking the clamps 63, 64 about the outer sleeve **18*b* of the shaft in the manner described above. Also, the guide sleeve 92 is positioned about the shaft. Assuming the apparatus is in its fully raised or horizontal position as seen in dashed lines in FIG. 5, it will be necessary to rotate the linkage 80 clockwise against the biasing force of the spring 88 prior to assembly of the guide sleeve 92 about the shaft. Thus in this position, the linkage 80 is biased in a counterclockwise direction and pushes against the motor 20 toward the left as seen in FIG. 5.**

To bring the motor into its operative position, that boat operator closes the switch 72 into its "down" position. The motor 68 is thereby energized to rotate the drive wheel 66 in a clockwise direction as seen in FIG. 2 and such that the second cable segment 75 pulls the slide block 56 forwardly. As will be understood, the clockwise rotation of the drive wheel also unwinds a sufficient length of the first cable segment 74 to permit the described movement of the slide block.

As the slide block 56 moves forwardly along the mounting frame, the linkage 80 rotates counterclockwise under the biasing force of the spring 88 to lift the motor 20 form its position resting upon the upper edges 35 of the rails. Subsequently, the shaft 18 contacts the guide roller 46 and then slides outwardly through the sleeve 92. Thus the guide roller 46 serves as a contact point for pivoting the motor 16 and the bracket 60 into their vertically disposed positions, which is reached when the slide block 56 reaches its fully forward position. At this same time, the tabs 96 of the keys 95 enter the channels 97 of the bracket 60 to preclude reverse pivotal movement. Also, the slide block engages and opens the limit switch 79 to automatically terminate operation of the motor 68 at this time.

From the above description, it will be seen that the forward pivotal movement of the motor and bracket proceeds under a controlled movement. In other words, while the second cable segment 75 pulls the slide block forwardly, the first cable segment 74 serves to prevent any sudden forward movement of the slide block and dropping of the motor 16 after the center of gravity of the motor passes over the guide roller 46.

When it is desired to retract the motor 16, the operator closes the switch 72 into its "up" position, thereby causing the drive wheel 66 to rotate counterclockwise as seen in FIG. 2. The first cable segment 74 thus pulls the slide block rearwardly along the mounting frame, causing the shaft 18 to engage the guide roller 46 and thereby pivot the motor 16 and bracket 60 toward their horizontal positions. Concurrently, the linkage 80 rotates in a clockwise direction as seen in FIG. 5, with the shaft initially sliding through the sleeve 92.

The motor 20 engages the guide flange 94 at the free end of the linkage 80 during the latter portion of the translation of the slide block 56 toward its withdrawn position, to thereby cause the linkage 80 to continue its pivotal movement in the clockwise direction and lift the motor 20 to a level above the upper edge 35 of the mounting frame. By design, the linkage 80 is pivoted clockwise slightly beyond its vertical position when the slide block 56 reaches its fully withdrawn position, such that the motor 20 is lowered onto and is supported by the upper edge of the mounting frame. When the slide block reaches its withdrawn position, it contacts and opens the limit switch 78 to thereby terminate operation of the motor 68.

As will be apparent from FIG. 5, the guide flange 94 contacts the body of the motor 20 during the withdrawal operation, and thereby serves to rotate the motor 20 from its longitudinal orientation into a lateral orientation. By this arrangement, the body of the motor 20 is disposed against the upper edge 35 of the mounting frame, and the chance for damage to the propeller 21 is avoided. The configuration of the guide flange 94 is determined by the shape of the motor 20, and it will be understood that the configuration of the flange will vary with different motors.

In the drawings and specification, there has been set forth a preferred embodiment of the invention, and although specific terms are employed, they are used in a generic and descriptive sense only and not for purposes of limitation.

What is claimed is:

1. An apparatus for pivotally mounting an outboard motor, such as a shaft-mounted submersible electric motor, on a fishing boat or the like and such that the motor may be selectively pivoted between a vertically disposed operative position in the water and a horizontally disposed raised position removed from the water, said apparatus comprising an elongated mounting frame adapted to be fixedly attached to a boat so as to extend in a generally horizontal direction, and defining an inner end and an outer end, a slide block mounted for slideable linear movement along substantially the full length of said mounting frame and between a forward position adjacent said outer end of said frame and a withdrawn position adjacent said inner end of said frame, a bracket pivotally carried by said slide block for pivotal movement about an axis extending transverse to the direction of sliding movement of said slide block and between a horizontal position overlying said slide block and an upright vertical position, means carried forwardly of said bracket for attaching the shaft of an outboard motor to said bracket and such that the motor is substantially horizontally disposed when said bracket is in said horizontal position and is substantially vertically disposed forwardly of said mounting frame when said bracket is in said vertical position and said slide block is in its forward position, guide means adapted to engage the shaft of the outboard motor at a point spaced from said attaching means for pivoting the outboard motor and bracket from their vertical positions to their horizontal positions during translation of the slide block from its forward position to its withdrawn position, and for pivoting the outboard motor and bracket from their horizontal positions to their vertical positions during translation of the slide block from its withdrawn position to its forward position, and means for selectively translating said slide block between said forward and withdrawn positions to thereby pivot the motor between its vertical and horizontal positions.

2. The apparatus as defined in claim 1 wherein said guide means comprises a guide roller mounted adjacent said outer end of said mounting frame and positioned to engage the shaft of the outboard motor during translation of the slide block between its forward and withdrawn positions.

3. The apparatus as defined in claim 2 further comprising means carried by said mounting frame and adapted to slideably engage the shaft and be actuated by contact with an enlarged portion of the outboard motor during the latter portion of the translation of the slide block toward its withdrawn position for lifting the shaft and motor to a horizontal position above said mounting frame during translation of the slide block to its withdrawn position.

4. The apparatus as defined in claim 3 wherein said lifting means includes means for rotating the motor into a predetermined orientation during translation of the slide block to its withdrawn position.

5. The apparatus as defined in claim 2 wherein said means for translating said slide block comprises a pulley carried by said mounting frame adjacent said inner end thereof, a drive wheel carried by said mounting frame and mounted for rotation about a fixed axis intermediate said guide roller and said pulley, a reversible electric motor for selectively rotating said drive wheel in either direction, and a cable operatively entrained about said drive wheel, guide roller, and pulley, said cable being fixedly attached to said slide block whereby operation of said motor serves to translate said slide block between said forward and withdrawn positions.

6. The apparatus as defined in claim 5 wherein said means for translating said slide block further comprises a manually operable switch for selectively operating said electric motor in either direction.

7. The apparatus as defined in claim 6 wherein said means for translating said slide block further comprises a limit switch positioned adjacent each of said inner and outer ends of said mounting frame for terminating operation of said electric motor, and wherein one limit switch is positioned to be operatively engaged by said slide block upon reaching its forward position and the other limit switch is positioned to be operatively engaged by said slide block upon reaching said withdrawn position.

8. An apparatus for pivotally mounting an outboard motor, such as a shaft-mounted submersible electric motor, on a fishing boat or the like and such that the motor may be selectively pivoted between a vertically disposed operative position in the water and a horizontally disposed raised position removed from the water, said apparatus comprising an elongated mounting frame adapted to be fixedly attached to a boat so as to extend in a generally horizontal direction, and defining an inner end and an outer end, a slide block, means for mounting said slide block for slideable linear movement along substantially the full length of said mounting frame and between a forward position adjacent said outer end of said frame and a withdrawn position adjacent said inner end of said frame, a bracket pivotally carried by said slide block for pivotal movement about an axis extending transverse to the direction of sliding movement of said slide block and between a horizontal position overlying said slide block and an upright vertical position.

means carried by said bracket for attaching the shaft of an outboard motor to said bracket such that the motor is substantially horizontally disposed when said bracket is in said horizontal position and is substantially vertically disposed when said bracket is in said vertical position, said attaching means extending forwardly from said bracket such that the outboard motor is held forwardly of said mounting frame when said slide block is in its forward position and said bracket is in its upright position, means for selectively translating said slide block between said forward and withdrawn positions, means for pivoting and lifting the outboard motor from its vertically disposed position forwardly of said mounting frame to a horizontally disposed raised position overlying said mounting frame during translation of the slide block from its forward position to its withdrawn position, and for pivoting and lowering the shaft and motor from said raised position to said vertically disposed position during translation of the slide block from said withdrawn position to said forward position, said means comprising a. a guide roller mounted adjacent said outer end of said mounting frame and positioned in alignment with the direction of movement of said slide block, b. a linkage having one end pivotally carried by said mounting frame at said outer end thereof for pivotal movement in a plane parallel to the direction of movement of said slide block, and an opposite free end, c. a guide sleeve pivotally carried at said free end of said linkage and being adapted to slideably receive the shaft of the outboard motor therewithin, said linkage having a length such that the guide sleeve may be freely pivoted about said outer end of said mounting frame and is positioned in spaced relation above said mounting frame when said linkage is pivoted to a vertically upright position, and d. means for biasing said linkage in a downward rotational direction about said outer end of said mounting frame, whereby upon the slide block being translated from its forward to its withdrawn position the shaft engages the guide roller and is pivoted there about, and the linkage is pivoted upwardly with the shaft and is engaged by the motor to cause the linkage to lift the shaft and motor upwardly over the outer end of said mounting frame, and upon said slide block being translated from said withdrawn position to said forward position, said biasing means causes the linkage to lift the shaft and motor from the mounting frame and pivot the same about said guide roller.

9. The apparatus as defined in claim 8 further comprising means for automatically locking said bracket in its vertical position upon said slide block being translated into its forward position.

10. The apparatus as defined in claim 9 wherein said locking means comprises a transversely directed key fixedly carried by said mounting frame adjacent said outer end thereof, and a channel positioned in said bracket, said channel being configured to receive said key when said bracket is in its vertical position and said slide block is in its forward position to thereby preclude pivotal movement of said bracket.

11. The apparatus as defined in claim 8 wherein said mounting frame comprises a pair of spaced apart parallel rails defining inwardly facing opposing surfaces, and wherein said means for mounting said slide block comprises a slot carried in each of said opposing surfaces and a transversely projecting follower extending from each side of said slide block and with each follower being slideably disposed within one of said slots.

12. The apparatus as defined in claim 11 wherein said guide roller is mounted for rotation about an axis extending transversely between said rails, and said means for selectively translating said slide block comprises a. a pulley mounted between said rails adjacent said inner end of said mounting frame and being rotatable about a transverse axis extending parallel to said guide roller axis, b. a cable entrained about said guide roller and pulley and extending along said mounting frame intermediate said rails, said cable being fixedly attached to said slide block, and c. means for selectively translating said cable in either direction.

* * * * *